US007497406B2

(12) United States Patent
Hudson

(10) Patent No.: US 7,497,406 B2
(45) Date of Patent: Mar. 3, 2009

(54) ART BRIDGE

(76) Inventor: William Allan Hudson, 9912 Aster Cir., Fountain Valley, CA (US) 92708

( * ) Notice: Subject to any disclaimer, the term of this patent is extended or adjusted under 35 U.S.C. 154(b) by 216 days.

(21) Appl. No.: 11/331,710

(22) Filed: Jan. 13, 2006

(65) Prior Publication Data

US 2007/0164186 A1 Jul. 19, 2007

(51) Int. Cl.
*B43L 15/00* (2006.01)

(52) U.S. Cl. ..... 248/118.3; 248/188.2; 101/127.1

(58) Field of Classification Search ..... 248/118.3, 248/118, 118.1, 118.5, 188.2; 434/85, 87, 434/88, 155, 164, 408, 415, 425; 101/127.1, 101/128; 269/2, 55, 74, 86
See application file for complete search history.

(56) References Cited

U.S. PATENT DOCUMENTS 744,287 A * 11/1903 Brasel ..... 248/118.3
794,042 A * 7/1905 O'Connor ..... 248/118.3
2,003,482 A 6/1935 Fancher
3,008,618 A * 11/1961 Watts et al. ..... 294/165
3,159,372 A 12/1964 McIntosh
3,389,724 A * 6/1968 Paul ..... 83/75
4,060,030 A * 11/1977 Noschese ..... 101/127.1
4,188,006 A * 2/1980 Karlin ..... 248/118.3
4,291,602 A * 9/1981 Fast et al. ..... 83/745
4,467,991 A 8/1984 Bailes
4,685,644 A * 8/1987 Yates ..... 248/118.3
5,184,987 A * 2/1993 Wilkinson ..... 482/52
6,691,972 B1 * 2/2004 Oliver ..... 248/441.1
6,857,616 B1 2/2005 Gasperi et al.

* cited by examiner

*Primary Examiner*—Korie Chan
(74) *Attorney, Agent, or Firm*—Fulwider Patton LLP

(57) ABSTRACT

A bridge is sized to span across an entire painting surface and is supported above the image by vertical spacers that adapt to vary the distance between the painting surface and the bridge. The bridge height above the image surface may be varied with the use of height adjusting supplemental vertical spacers. The bridge is made up of an upper block and a lower block, where the upper block can be temporarily separated from the lower block. Each block may include a resilient material such as a thin neoprene layer or other suitable material on the respective mating surfaces, such that the resilient layers are pressed against each other when the halves are connected and held in place by fasteners. Between the resilient layers, the artist can place any desired drawing guide, and the guide is held firmly in place by the non-slip quality of the resilient layers.

9 Claims, 5 Drawing Sheets

ART BRIDGE

BACKGROUND OF THE INVENTION

The present invention relates generally to aids for artistry such as painting and drawing, and more particularly to a bridge that can carry a stencil without smudging or smearing a freshly drawn or painted surface.

Many drawing tools exist to aid draftsmen and designers in guiding the path of their pencils and pens when laying out designs on paper, vellum, and the like. These tools include: straight edges, templates, stencils, French curves, ship's curves, etc. Typically, these tools are placed on or slightly above the surface on which the images are drawn (i.e. the paper). The hard surface of the pen or pencil glides against the hard surface of the template and the template shapes are replicated.

Fine artists also have the need for similar tools to guide the path of their paint brushes over surfaces such as stretched-canvas and watercolor paper. However, when adapted to brushes with long bristles/hairs the tools just described are impractical when held near the painting surface. They impede the flow of paint, cause the paint to smear, and have little accuracy when the flimsy brush hairs are run against the rigid surface of the template.

A device known as a Maulstick (or Mahlstick) has been used by artists for centuries. It is simply a rod with a spherical end that rests on the painting or on a nearby object. The artist holds the other end of the Maulstick in his left hand, for example, and places his right hand with loaded brush on the stick for support while applying paint. Maulsticks have limited applicability for drawing precise shapes, and rely on the skill of the artist in holding the device steady while concentrating on the painting strokes. As such, Maulsticks are not very helpful to the object of the present invention.

Art bridges that have feet which sit on the painting surface are also known in the art. These bridges, however, have little utility as brush guides. They have only straight edges, are typically short in length and, consequently, cannot be used without sitting directly on the painted portion of the surface. The straight edges also rest close to the painting surface, thereby limiting their utility as a guide for long-haired paint brushes.

It can be appreciated that a fine artist who applies paint (oil, acrylic, watercolor) to a surface often needs a bridge that does not rest on the image and allows his brushes to follow multiple available guides. These guides need to be supported by the bridge at sufficient heights above the image that the contact with the brush is above the bristles, e.g. at the brush ferrule or brush handle. The brush hairs would have no contact with the guide or bridge and the flow of paint would not be impeded. The present inventor is aware of no such device that addresses the shortcomings described above.

SUMMARY OF THE INVENTION

In a first preferred embodiment of the present invention, a bridge is sized to span across an entire painting surface. The bridge is held above the image by sliders which move along the bridge via tongue and groove connections to adapt to varied table and/or image sizes. The bridge height above the image surface can also be varied with the use of height adjusting blocks. The bridge is made up of an upper block and a lower block, where the upper block can be temporarily separated from the lower block. Each block may include a resilient material such as a thin neoprene layer or other suitable material on the respective mating surfaces, such that the resilient layers are pressed against each other when the halves are connected and held in place by fasteners. Between the resilient layers, the artist can place any desired drawing guide. The guide is held firmly in place by the soft, adhesive qualities of the resilient layers. For example, if the artist desired to paint the thin rigging lines of a sailing vessel, a plastic ship's curve may be placed between the upper and lower blocks of the bridge and secured to trap the curve between the resilient layers. The bridge and ship's curve may then be oriented properly over the painting. The height of the bridge may also be adjusted so that the ferrule of the brush contacts and glides along the ship's curve as the bristles contact the canvas. The present invention thus allows an artist to paint even long thin lines or complex curves with controlled accuracy. If straight lines are required, the artist can insert an appropriate template such as a drawing triangle between the neoprene layers. Other templates, such as circle templates, ellipse templates, etc. can be quickly exchanged and inserted into the bridge so that shapes can be confidently, accurately, and smoothly painted.

The bridge, sliders, and height adjusting blocks are currently made of a sturdy wood such as oak with fasteners fashioned from walnut dowel rods. The sliders and height adjusting blocks may be held together with thin magnetic strips. At the underside of the two ends of the bridge lower half are wooden slider stops. These are removable, but when inserted they prevent the sliders from slipping off the bridge assembly.

In a second preferred embodiment of the present invention, the sliders of the first embodiment are replaced with a clamp assembly that attaches to the canvas frame. The clamp assembly also has a thumbscrew adjustment that varies the distance of the bridge from a suspended canvas. Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
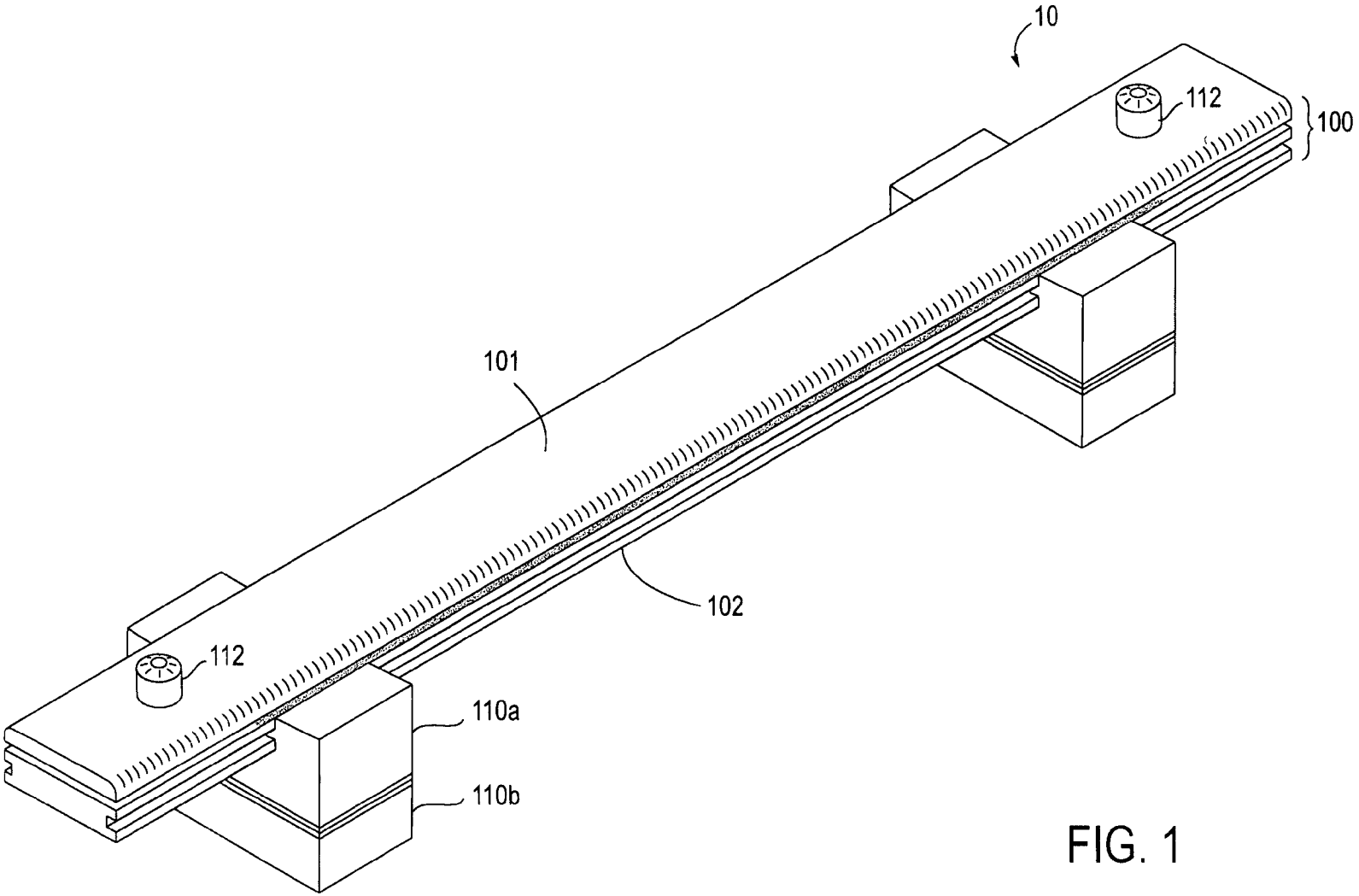
FIG. 1 is an elevated perspective view of a first embodiment of the present invention.
Figure 2:
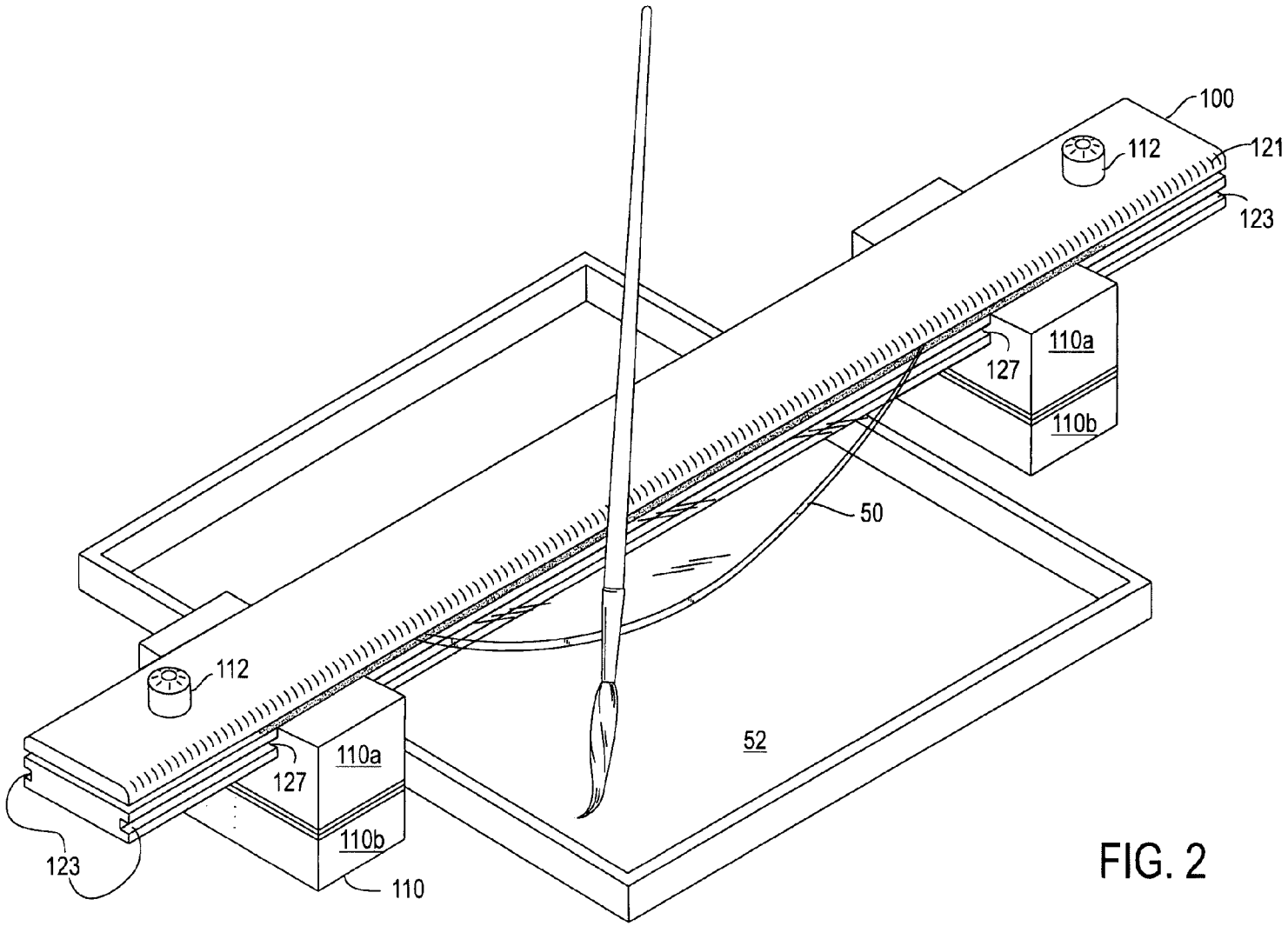
FIG. 2 is the first embodiment of FIG. 1 showing a curve secured between the upper and lower blocks of the bridge with the sliders straddling a painting surface.

The present invention is intended to aid the fine artist in painting on surfaces that can be placed on a flat or slightly inclined surface. The bridge, by itself, may be used as a support for the artist's hand. As shown in FIG. 2, the bridge may also be used with readily available drawing aids (such as templates, stencils, curves, straight edges, etc.) to paint exact shapes in any orientation.

Figure 4:
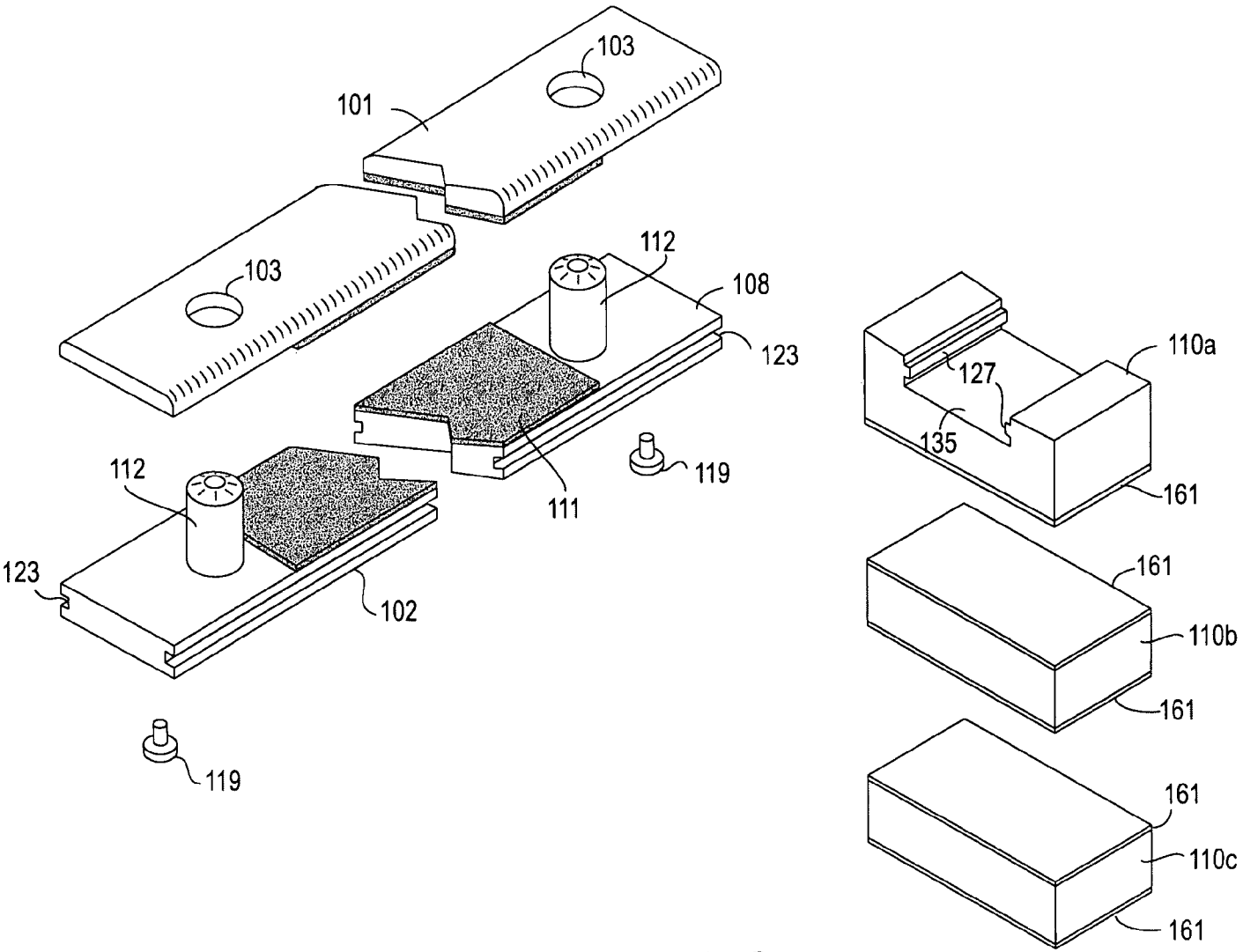
FIG. 4 is an elevated, exploded view, partially cut away, of the embodiment of FIG. 1.

In a first preferred embodiment, a bridge 10 is formed by a two piece transverse support beam 100 resting a left and right adjustable vertical spacers 110. The two piece transverse support beam 100 is comprises of an upper block 101 and a lower block 102 having a length L (where L may by any length but in a first embodiment is forty-eight inches), where upper block 101 and lower block 102 preferably share a common footprint. A front edge 121 of the upper block 101 may have a rounded upper corner to permit contact with a brush ferrule at various angles. The upper block 101 further includes first and second apertures 103 that are aligned with and concentric with corresponding apertures 104 on the lower block 102. A pin or dowel 112 sized to be received into the apertures 103, 104 is shown in FIG. 4 to keep the upper block 101 and lower block 102 aligned, although other alignment mechanisms such as a lip on one block that abuts the second block can be substituted for the dowels 112. The lower block 102 is preferably formed with longitudinal slots 123 on a forward surface and a rearward surface that engage tabs 127 on the upper vertical spacer 110*a* to fix the lower block 102 on the spacer 110. When the lower block 102 is slid laterally into the upper vertical spacer 110*a* with the tabs 127 occupying the longitudinal slots 123, the two piece transverse support beam 100 is firmly established in the vertical spacers 110 to provide a stable support for the artist.

Figure 3D:
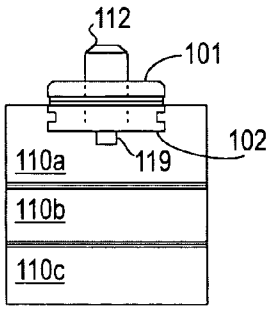
FIG. 3*d* is a side view, partially cut away and partially in shadow, of the embodiment of FIG. 1.
Figure 3A:
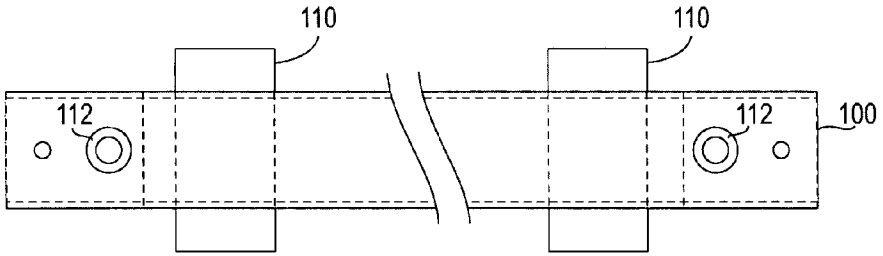
FIG. 3*a* is a top view, partially cut away and partially in shadow, of the embodiment of FIG. 1.
Figure 3B:
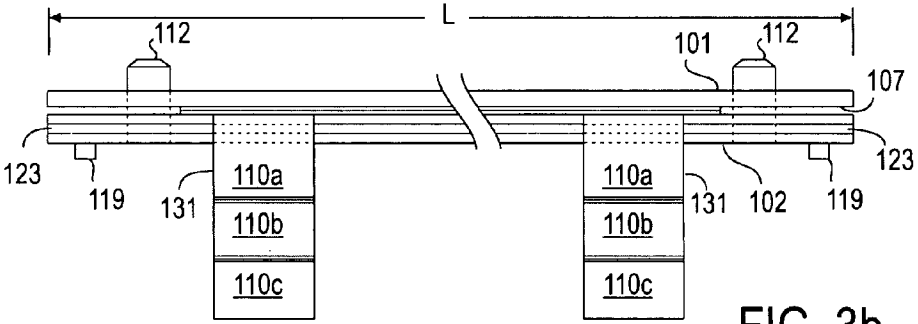
FIG. 3*b* is a front view, partially cut away and partially in shadow, of the embodiment of FIG. 1.
Figure 3C:
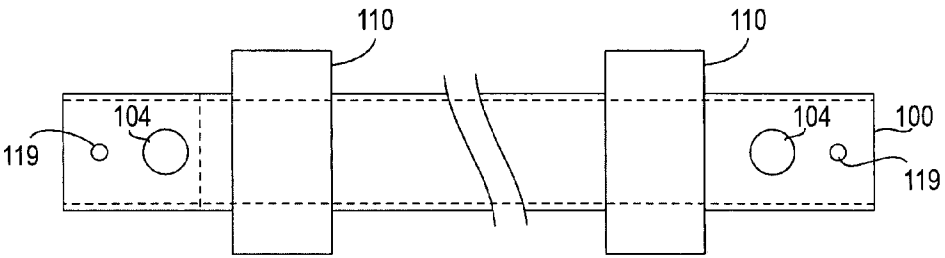
FIG. 3*c* is a bottom view, partially cut away and partially in shadow, of the embodiment of FIG. 1.

The upper block 101 includes a lower surface 107 that opposes an upper surface 108 on the lower block 102. The lower surface 107 and the upper surface 108 include adhered thereto a portion of resilient material 111 such as, for example, neoprene. The resilient material 111 should have a tacky tactile characteristic to aid in resisting slippage of a stencil 50 or drawing utensil when compressed between the upper block 101 and the lower block 102. As shown in FIG. 2, the stencil 50 is placed between the upper block 101 and the lower block 102, and the vertical spacers 110 provide a gap (see FIG. 3*b* for example) that enables the point of contact with a brush to be as small as one to two centimeters, up to ten centimeters or more if necessary by adding additional vertical spacers 110*b*, 110*c*.

The lower block 102 may further include first and second stops 119 that engage an outer surface 131 of the upper vertical spacer 110 and prevents the two piece transverse support beam 100 from sliding out of the vertical spacers 110. Also, the dowels 112 may be replaced with a threaded member that engages a cap (not shown) to not only align the upper block 101 with the lower block 102, but also provide a compressive force that can relieve the artist of the need to hold the bridge down while painting.

As shown particularly in FIG. 4, the upper vertical spacer 110*a* is formed with a recess 135 sized to receive the lower block 102 there, with the tabs 127 aligned with the longitudinal slots 123 of the lower block to permit sliding of the lower block (and thus the two piece transverse support beam 100) thereon. The vertical spacer 110*a* can be stacked on top of additional vertical spacers 110*b*, 110*c*, to increase the vertical distance between the two piece transverse support beam 100 and the painting surface 52.

To use the first preferred embodiment of the present invention shown in FIGS. 1-4, the artist follows the procedure below:

(1) The surface 52 on which the artist is painting (e.g. the canvas or watercolor paper) is placed on a table top.

(2) The bridge 10 is then placed across the painting surface. The vertical spacers 110 are placed on each side of the painting surface. The vertical spacers 110 allow the bridge 10 to sit firmly on a table.

(3) The bridge height above the painting surface 52 is then established by the artist with the addition or deletion of supplemental vertical spacers 110*b*, 110*c*, etc. The vertical spacers may be held together with magnets 161 adhered or otherwise mounted to opposing surfaces of the vertical spacer assembly.

(4) If the artist now wishes to paint an exact shape, he selects the appropriate drawing guide 50 (e.g. ship's curve, French curve, straight edge, template, etc).

(5) The artist then lifts the bridge upper block 101 from the lower block 102. This is best done at one of the connecting dowel rods 112.

(6) The artist then places the drawing guide 50 between the resilient layers 111 the bridge upper block 101 and the bridge lower block 102, and replaces the upper block 101 on top of the lower block 102.

(7) With the upper and lower blocks secured in place at the dowels 112, the artist may then run the brush ferrule or handle along the drawing guide to paint the desired shape.

Figure 5:
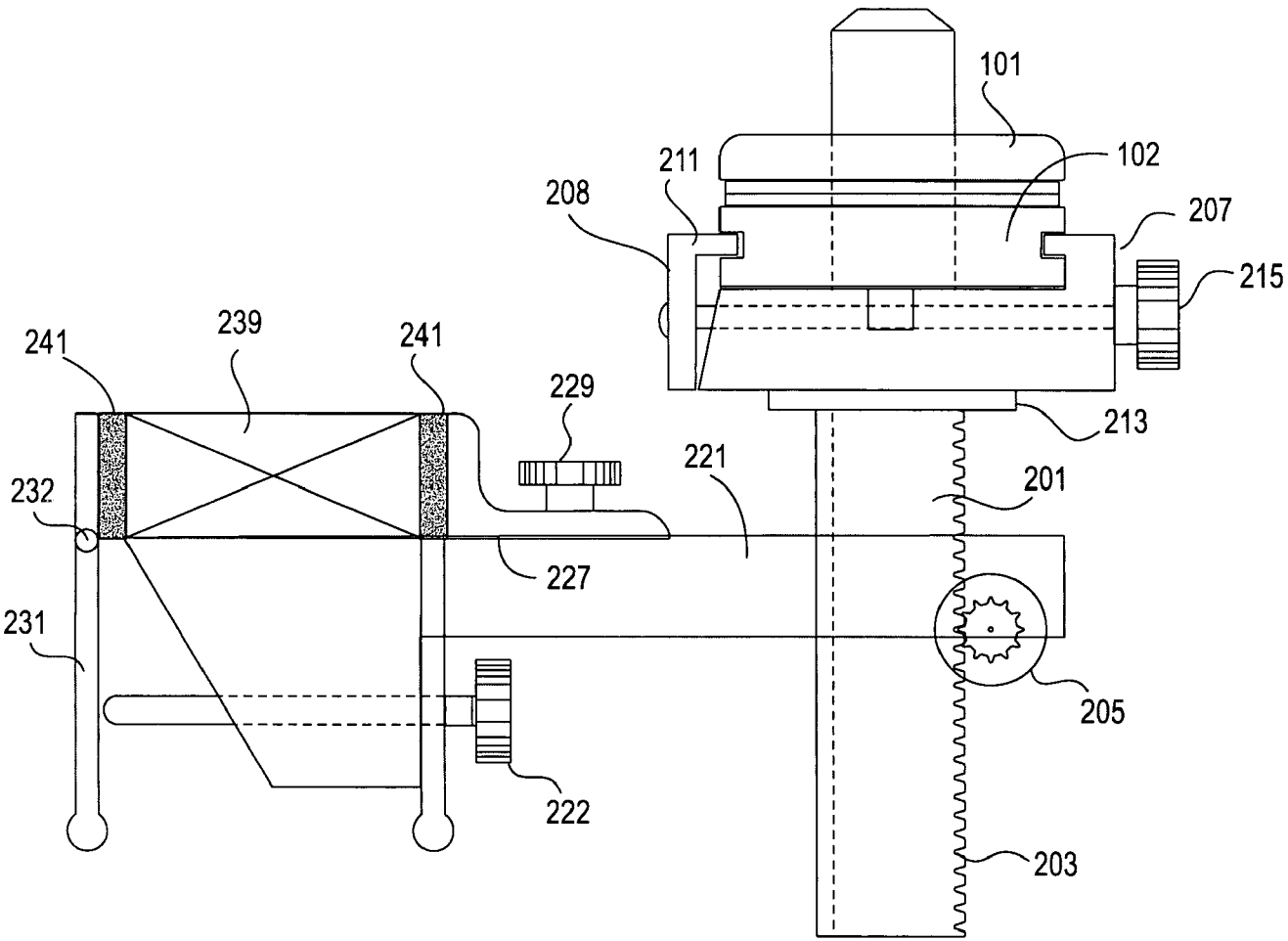
FIG. 5 is a side view of a second embodiment of the present invention.

FIG. 5 illustrates a second preferred embodiment of the present invention, which is intended to aid an artist in painting on vertically mounted canvases. In FIG. 5, the vertical spacers of the previous embodiment have been replaced by a pair of rods 201 with teeth 203 along a first edge that allows each rod 201 to be driven linearly by a gear knob 205. Rotation of the gear knob 205 causes the rod 201 to move linearly tangential to the gear knob 205, which is mounted to a clamping assembly that engages an easel or other vertical structure for painting in a vertical (or predominantly vertical) plane. This provides a continuum of available distances between the minimum and maximum available distances of the rod. The rod 201 is mounted to a base 207 via a swivel joint 213, such that the rod 201 cooperates with a retaining member 208 to support the transverse support beam 100 comprising the upper and lower blocks, 101, 102, respectively. The base 207 and retaining member 208 are coupled by an adjustment screw 215 that separates and closes the base and retaining member to secure the transverse support beam 100 therein. The base 207 and the retaining member 208 include tabs 211 that engage the longitudinal slots 123 of the lower block 102 in a similar manner to that described above with respect to the first embodiment, such that the beam 100 slides within the base/retaining member combination in a lateral direction but is fixed with respect to all other movement.

The rod 201 is held by a clamp block 221 that includes a set screw 222 and an adjustable brace 227 that locks onto the clamp block 221 using a thumb screw 229. The adjustable brace 227 cooperates with a clamp grip 231 to fix the structure to a easel or board. In practice, the artist follows the procedure below to establish the position and height of the bridge on the canvas.

(1) The artist loosens the set screw 222.

(2) The artist also loosens the adjustment screw 215.

(3) The artist then squeezes the clamp grip 231 to release the clamp assembly from the canvas against the biasing force of the clipboard spring 232.

(4) The entire assembly is then moved to the desired location on the canvas.

(5) The artist then releases the clamp grip 231 to hold the assembly in place on the canvas frame 239, where rubber pads 241 can be used to protect the frame or prevent slippage.

(6) Repeat steps 1 through 5 for the identical assembly on the other side of the canvas.

(7) Then the artist tightens both assembly set screws 222.

(8) Then both adjustment screws 215 are tightened.

(9) The height of the bridge is adjusted by rotating the gear knobs 205.

(10) Insert the desired drawing guide as previously taught in the first embodiment.

The method and apparatus for carrying out the method described above is illustrative of the present invention. Those of ordinary skill in the art will readily recognize variations of the above-described methods and apparatus, and such variations should be considered within the scope of the invention. The above described methods and apparatus are not intended to be limiting in any manner, and the scope of the invention should be measured by the words of the appended claims, taken in their ordinary meaning in conjunction with the specification and documents cited therein.

I claim:

1. An art bridge comprising:

a beam formed of an upper portion and a lower portion, said beam sized to traverse an intended painting surface, said beam adapted to support a user's hand thereon and further comprising means for retaining a stencil in a plurality of fixed orientations;

vertically adjustable magnetic spacers supporting said beam in a transverse sliding relationship, said vertically adjustable spacers establishing a distance between said intended painting surface and said bridge where said distance is selected by the user, said vertically adjustable spacers further including a tab that engages a longitudinal slot on said beam to fix said beam and said vertically adjustable spacers in a sliding relationship.

2. An art bridge comprising:

a beam formed of an upper portion and a lower portion, said beam sized to traverse an intended painting surface, said beam adapted to support a user's hand thereon and further comprising a resilient material disposed on opposing surfaces of said upper portion and lower portion to grip a stencil therebetween when said upper portion is placed over said lower portion for retaining a stencil in a plurality of fixed orientations; and vertically adjustable spacers supporting said beam in a transverse sliding relationship, said vertically adjustable spacers establishing a distance between said intended painting surface and said bridge where said distance is selected by the user, said vertically adjustable spacers further including a tab that engages a longitudinal slot on said beam to fix said beam and said vertically adjustable spacers in a sliding relationship.

3. The art bridge of claim 1 further comprising alignment pins cooperating with said upper portion and lower portion of said beam to align said upper portion on said lower portion.

4. An art bridge comprising:

a beam formed of an upper portion and a lower portion, said beam sized to traverse an intended painting surface, said beam adapted to support a user's hand thereon and further comprising means for retaining a stencil in a plurality of fixed orientations;

vertically adjustable spacers supporting said beam in a transverse sliding relationship, said vertically adjustable spacers establishing a distance between said intended painting surface and said bridge where said distance is selected by the user, said vertically adjustable spacers further including a tab that engages a longitudinal slot on said beam to fix said beam and said vertically adjustable spacers in a sliding relationship; and first and second stops on a lower surface of said beam that cooperate with said vertically adjustable spacers to limit the sliding motion of the beam between the first and second stops.

5. The art bridge of claim 1 wherein said vertically adjustable spacers provide a continuum of available distances between a minimum and maximum distance.

6. The art bridge of claim 5 further comprising clamping means for securing the art bridge to a vertical frame.

7. The art bridge of claim 6 wherein said clamp means is adjustable to clamp onto different width frames.

8. The art bridge of claim 5 wherein said vertically adjustable spacers include a base and a retaining member that cooperate to secure the beam therebetween in a releasable engagement.

9. The art bridge of claim 8 wherein said base and retaining member are coupled by a threaded member that opens and closes the base and retaining member.

* * * * *